US009524610B2

(12) United States Patent
Aoki

(10) Patent No.: US 9,524,610 B2
(45) Date of Patent: Dec. 20, 2016

(54) GAMING MACHINE WITH SYMBOL ENHANCEMENTS BASED ON WINNING OUTCOMES

(75) Inventor: Dion K. Aoki, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 2764 days.

(21) Appl. No.: 12/066,237

(22) PCT Filed: Sep. 8, 2006

(86) PCT No.: PCT/US2006/035195

§ 371 (c)(1), (2), (4) Date: Mar. 7, 2008

(87) PCT Pub. No.: WO2007/030787

PCT Pub. Date: Mar. 15, 2007

(65) Prior Publication Data

US 2008/0242404 A1 Oct. 2, 2008

Related U.S. Application Data

(60) Provisional application No. 60/715,409, filed on Sep. 9, 2005.

(51) Int. Cl.
*G07F 17/32* (2006.01)

(52) U.S. Cl.
CPC ..... *G07F 17/3244* (2013.01)

(58) Field of Classification Search
USPC ..... 463/16, 20, 25, 26
See application file for complete search history.

(56) References Cited

U.S. PATENT DOCUMENTS

| | | | | | |
|---|---|---|---|---|---|
| 5,431,408 | A * | 7/1995 | Adams | 273/306 |
| 5,655,961 | A * | 8/1997 | Acres et al. | 463/27 |
| 5,902,184 | A * | 5/1999 | Bennett | 463/13 |
| 6,004,207 | A * | 12/1999 | Wilson et al. | 463/25 |
| 6,068,552 | A * | 5/2000 | Walker et al. | 463/21 |
| 6,117,009 | A * | 9/2000 | Yoseloff | 463/20 |
| 6,155,925 | A * | 12/2000 | Giobbi et al. | 463/20 |
| 6,217,448 | B1 * | 4/2001 | Olsen | 463/25 |
| 6,231,445 | B1 * | 5/2001 | Acres | 463/42 |
| 6,254,483 | B1 | 7/2001 | Acres | 463/26 |
| 6,270,411 | B1 * | 8/2001 | Gura et al. | 463/20 |
| 6,328,649 | B1 * | 12/2001 | Randall et al. | 463/20 |
| 6,358,150 | B1 | 3/2002 | Mir et al. | 463/28 |

(Continued)

OTHER PUBLICATIONS

International Search Report, (2 pages) dated Feb. 3, 2007.

*Primary Examiner* — Jason Skaarup
(74) *Attorney, Agent, or Firm* — Nixon Peabody LLP

(57) ABSTRACT

A wagering game in a gaming machine includes symbols that are associated with multiple payoff levels. The symbols may have their payoff levels incremented and decremented based on certain predefined criteria. The criteria may be based on a winning outcome, random selection, the position of the symbols, the configuration of the symbols, and the like. As some symbols have their payoff levels incremented, other symbols have their payoff levels decremented. Each symbol may be graphically rendered in a manner to distinctively indicate the particular payoff level currently assigned to that symbol. In this way, the wagering game maintains a dynamic mix of symbols having different payoff levels and graphical renderings.

12 Claims, 6 Drawing Sheets

(56) References Cited

U.S. PATENT DOCUMENTS

| | | | | |
|---|---|---|---|---|
| 6,485,367 | B1 | 11/2002 | Joshi | 463/13 |
| 6,517,432 | B1 * | 2/2003 | Jaffe | 463/20 |
| 6,656,048 | B2 | 12/2003 | Olsen | 463/25 |
| 6,663,487 | B1 | 12/2003 | Ladner | 463/13 |
| 6,688,977 | B1 * | 2/2004 | Baerlocher et al. | 463/25 |
| 6,712,693 | B1 | 3/2004 | Hettinger | 463/20 |
| 6,921,335 | B2 * | 7/2005 | Rodgers et al. | 463/30 |
| 6,932,702 | B1 * | 8/2005 | Harris | 463/20 |
| 7,056,213 | B2 * | 6/2006 | Ching et al. | 463/20 |
| 7,121,942 | B2 * | 10/2006 | Baerlocher | 463/20 |
| 7,258,611 | B2 * | 8/2007 | Bigelow et al. | 463/25 |
| 7,513,826 | B2 * | 4/2009 | Cuddy | 463/20 |
| 7,695,363 | B2 * | 4/2010 | Gilliland et al. | 463/20 |
| 7,727,068 | B2 * | 6/2010 | Peterson | 463/25 |
| 7,758,414 | B1 * | 7/2010 | Marks et al. | 463/20 |
| 2001/0028147 | A1 | 10/2001 | Ornstein et al. | 273/292 |
| 2002/0058546 | A2 | 5/2002 | Acres | 463/25 |
| 2002/0082074 | A1 * | 6/2002 | Bennett | 463/20 |
| 2003/0022712 | A1 * | 1/2003 | Locke | 463/20 |
| 2003/0054872 | A1 * | 3/2003 | Locke et al. | 463/20 |
| 2003/0064768 | A1 * | 4/2003 | Fier | 463/13 |
| 2003/0157981 | A1 * | 8/2003 | Marks et al. | 463/20 |
| 2004/0038731 | A1 * | 2/2004 | Englman | 463/25 |
| 2005/0032573 | A1 | 2/2005 | Acres et al. | 463/25 |
| 2005/0059452 | A1 | 3/2005 | Hartl | 463/13 |
| 2005/0096121 | A1 * | 5/2005 | Gilliland et al. | 463/20 |
| 2005/0261046 | A1 | 11/2005 | Griswold et al. | 463/16 |

* cited by examiner

GAMING MACHINE WITH SYMBOL ENHANCEMENTS BASED ON WINNING OUTCOMES

CROSS-REFERENCE TO RELATED APPLICATIONS

This application is a U.S. national phase of, and claims priority to, International Application No. PCT/US2006/035195, filed Sep. 8, 2006, which claims the benefit of priority of U.S. Provisional Patent Application No. 60/715,409, filed Sep. 9, 2005, both of which are incorporated herein by reference in their entireties.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming machine with symbol enhancements that are based on winning outcomes.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus wagering game may comprise any type of game, either similar to or completely different from the basic wagering game, which is entered upon the occurrence of a selected event or outcome in the basic wagering game. Generally, bonus wagering games provide a greater expectation of winning than the basic wagering game and may also be accompanied by more attractive or unusual video displays and/or audio. Bonus wagering games may additionally award players with "progressive jackpot" awards that are funded, at least in part, by a percentage of coin-in from the gaming machine or a plurality of participating gaming machines.

Regardless of whether the bonus wagering game is triggered, all outcomes on the wagering game may be represented by a plurality of symbols. The symbols may be, for example, cards symbols, dice symbols, reel symbols, and so forth, depending on the particular type of gaming machine. Each symbol typically has a predefined payoff amount associated with it that is awarded to the player when the symbol appears in a certain configuration in the outcome. In a video slot machine, for example, three cherry symbols in a row results in a certain payoff amount to the player. This payoff amount, however, is typically tied to the symbol for at least the duration of the wagering game session and possibly permanently. That is to say, in existing wagering games, each symbol typically has only one payoff amount associated with the symbol and that payoff amount does not change.

Accordingly, there is a continuing need to develop gaming machines with new types of wagering games and enhanced game features that are less predictable to satisfy the demands of players and operators.

SUMMARY OF THE INVENTION

The present invention is directed to a wagering game in a gaming machine where some or all of the symbols are associated with multiple payoff levels. To enhance the level of enjoyment and excitement, these symbols may have their payoff levels incremented and decremented based on certain predefined criteria. The criteria may be based on a winning outcome, random selection, the position of the symbols, the configuration of the symbols, and the like. As some symbols have their payoff levels incremented, other symbols have their payoff levels decremented. Each symbol may be graphically rendered in a meaningful manner to distinctively indicate the particular payoff level currently assigned to that symbol. In this way, the wagering game can maintain a dynamic mix of symbols having different payoff levels and graphical renderings.

According to one aspect of the invention, a gaming machine comprises a value input device for accepting a wager input from a player and a display unit for displaying symbols representing an outcome of a wagering game. The outcome is randomly selected from a plurality of outcomes, including a special-event outcome. The symbols include at least first and second symbols having multiple possible payoff levels. In response to the randomly selected outcome being the special-event outcome in a current round of the wagering game, the payoff level for the first symbol is incremented for a subsequent round of the wagering game.

According to another aspect of the invention, a method of conducting a wagering game on a gaming machine comprises the step of accepting a wager input from a player at the gaming machine, the wager input initiating a round of a wagering game in which an outcome is randomly selected from a plurality of outcomes. The method further comprises the step of displaying symbols indicating the outcome of the wagering game, each symbol having a current payoff level, and the plurality of outcomes including a payoff level-changing outcome. At least one symbol is associated with a payoff level that is higher than that symbol's current payoff level for a subsequent round of the wagering game upon occurrence of the payoff level-changing outcome.

According to still another aspect of the invention, a method of conducting a wagering game on a gaming machine comprises the step of accepting a wager input from a player at the gaming machine, the wager input initiating a round of a wagering game in which an outcome is randomly selected from a plurality of outcomes. The method further comprises the step of displaying symbols representing the outcome that is randomly selected from the plurality of outcomes, each symbol capable of being associated with at least a standard payoff level, an intermediate payoff level, or a high payoff level. In response to an event in the wagering game, the payoff level of one or more of the symbols is shuffled among the standard payoff level, the intermediate payoff level, and the high payoff level for a subsequent round of the wagering game.

According to yet another aspect of the invention, a computer readable storage medium is encoded with instructions for directing a gaming machine to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1:
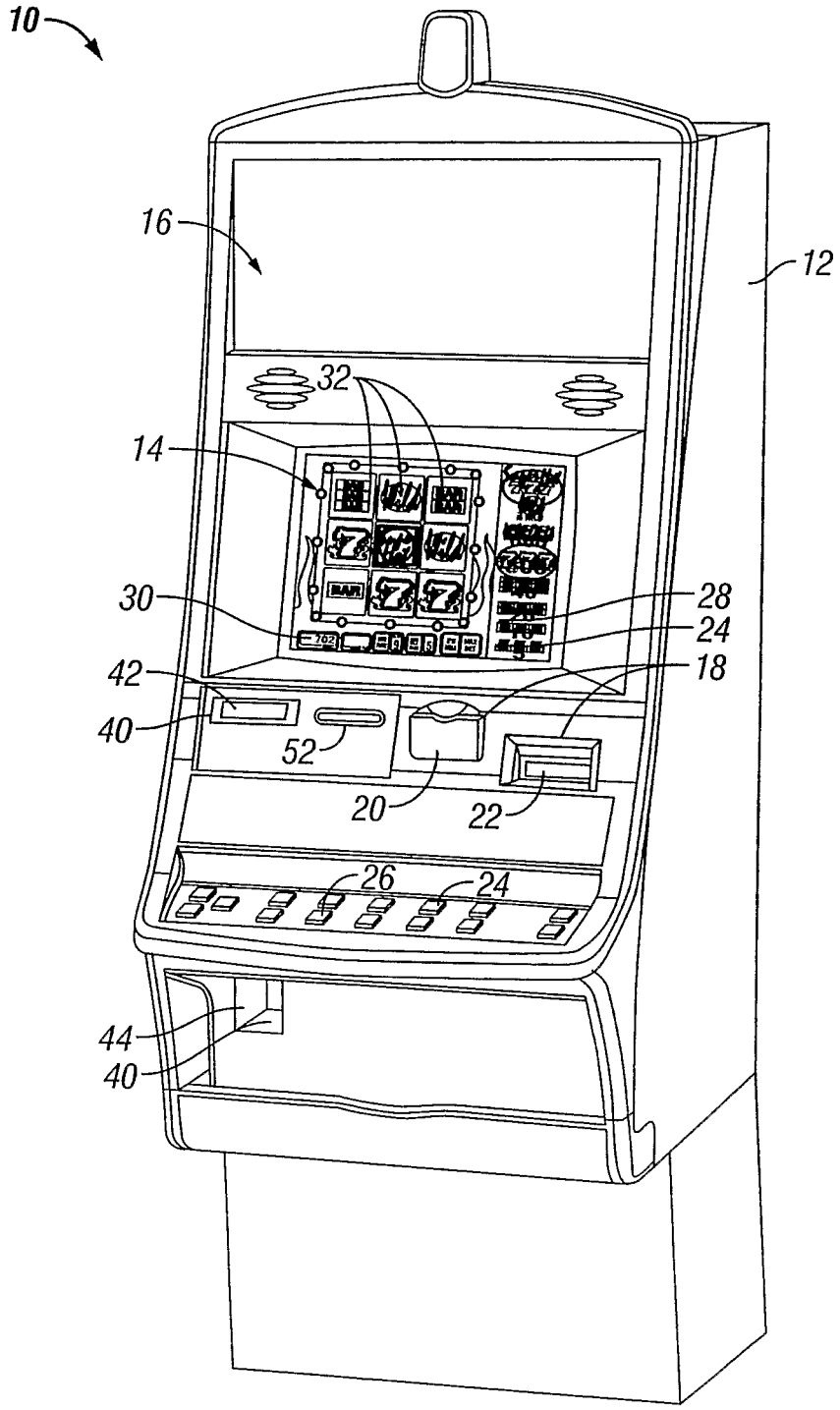
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 similar to the ones used in gaming establishments such as casinos is shown. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus wagering game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual association to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic wagering game consists of a plurality of symbols arranged in an array, and includes at least one payline 32 that indicates one or more outcomes of the basic wagering game. Such outcomes are randomly selected in response to the wager by the player. At least one of the plurality of randomly-selected outcomes may be a start-bonus outcome, which can include any variations of symbols or symbol combinations triggering a bonus wagering game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
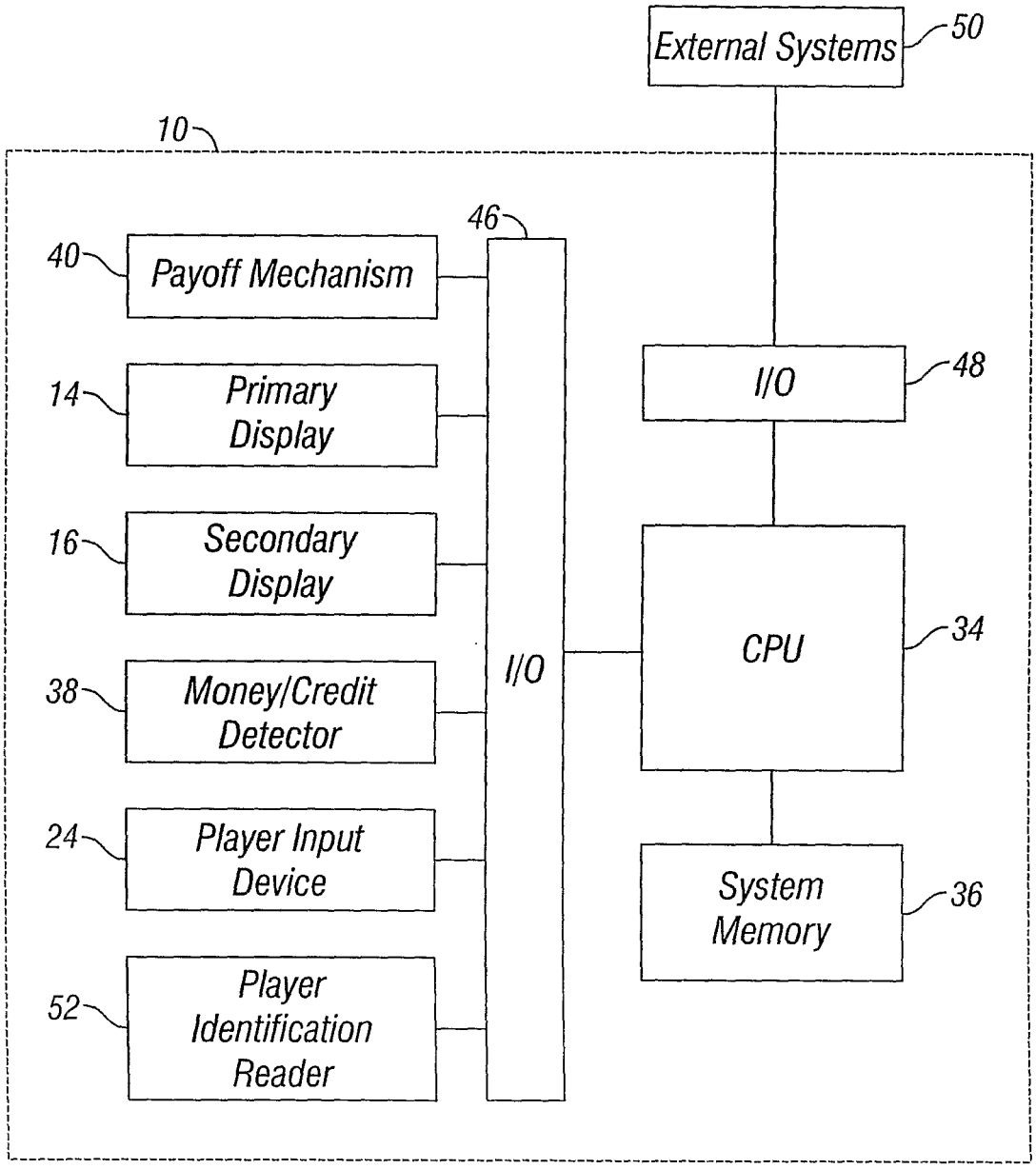
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic wagering game or the bonus wagering game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
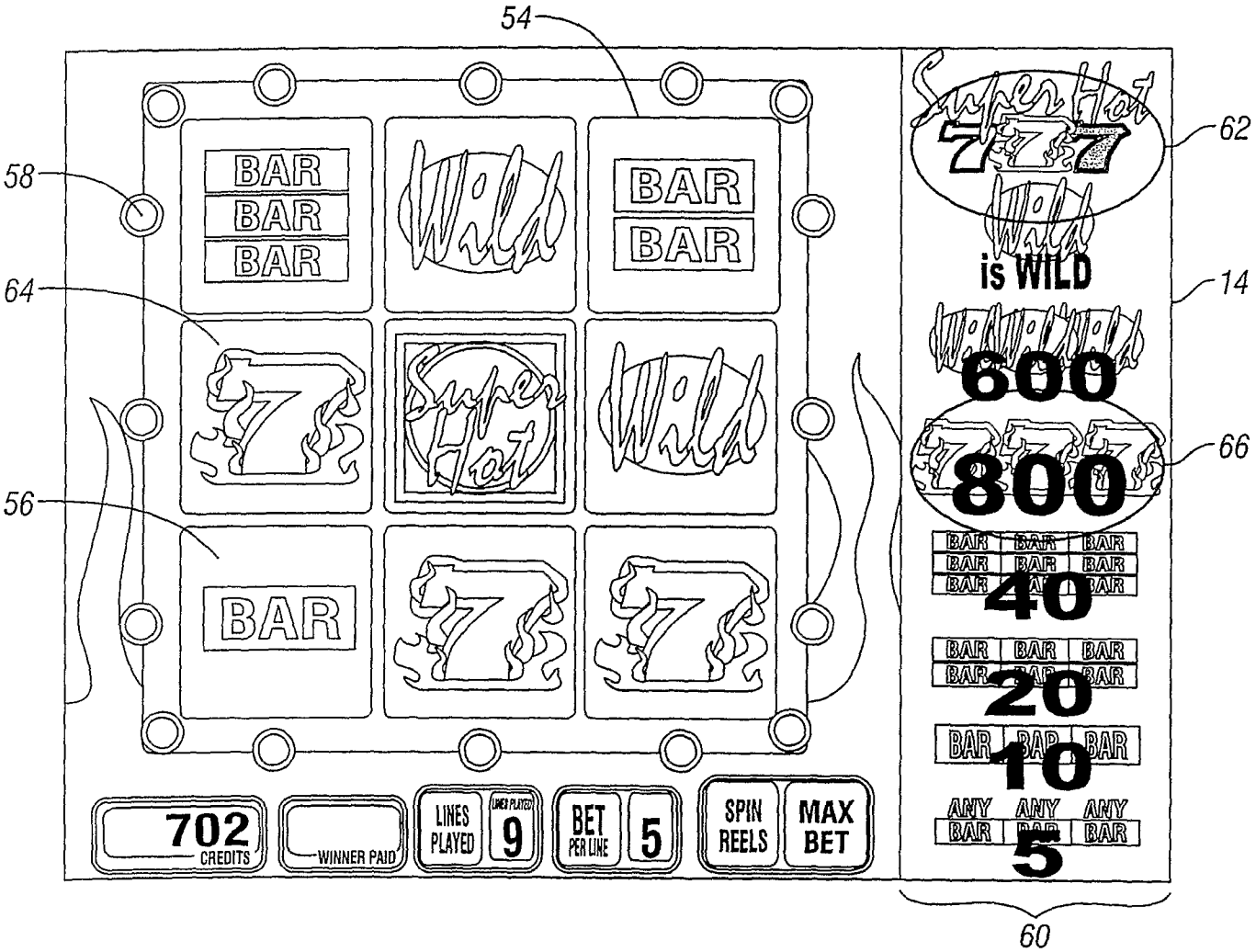
FIG. 3 illustrates a symbol combination representing an outcome of an exemplary wagering game that may be played on the gaming machine of FIGS. 1 and 2.

As mentioned above, all outcomes on the wagering game may be represented by a plurality of symbols. The symbols may be, for example, cards symbols, dice symbols, reel symbols, and so forth, depending on the particular type of gaming machine 10. FIG. 3 illustrates the primary display 14 of the gaming machine 10 displaying a plurality of symbols for an exemplary slot machine wagering game. The plurality of symbols represents the outcome of the wagering game, with each outcome being randomly selected from a plurality of outcomes. As can be seen, the wagering game here is a "Super Hot" slot machine game having nine reels, one or which is indicated at 54. Each reel 54, in turn, has a plurality reel symbols 56, with one of the reel symbols 56 visible per reel at any given time. The reels 54 and reel symbols 56 together form a three-by-three array for a total of nine possible reel positions. Payline indicators 58 identify the possible paylines for this particular wagering game while a pay table 60 identifies the possible payoff amounts.

In accordance with embodiments of the invention, some or all of the reel symbols 56 in the wagering game may be associated multiple payoff levels. For example, there may be three possible payoff levels, "standard," "intermediate" (i.e., "hot"), and "high" (i.e., "super hot"), assigned to the reel symbols 56. When an outcome occurs that produces an award to the player, a different payoff amount is awarded depending on the payoff level currently assigned to the reel symbol 56 that resulted in the award. The difference between the payoff amounts for the different payoff levels may be derived in various ways, for example, using a certain multiplier (e.g., 2×, 4×, 6×, etc.), a predetermined number of credits (e.g., 100, 200, 400, etc.), and so forth.

Each reel symbol 56 appearing on the display 14, regardless of the outcome of the wagering game, may then be depicted using a different graphical rendering. The different graphical rendering helps players recognize the payoff level currently assigned to that reel symbol 56. An example of the different graphical renderings is shown at 62 in FIG. 3, where the same "7" reel symbol is rendered in three different ways. As can be seen, the white color "7" indicates a "standard" payoff level, the red color "7" indicates an "intermediate" or "hot" payoff level, and the flame covered "7" indicates a "high" or "super hot" payoff level. Thus, when the "super hot" rendering for the "7" reel symbol appears in one of the reels 54, the player understands that the "high" payoff level is currently assigned to that symbol. An example of the "super hot" rendering for the "7" reel symbol appearing in one of the reels 54 is shown at 64, and the corresponding payoff amount of 800 credits currently assigned to this symbol shown at 66 (in the pay table 60). Different graphical renderings (e.g., size instead of color) may be used for different reel symbols 56 to indicate the various payoff levels.

Figure 4A:
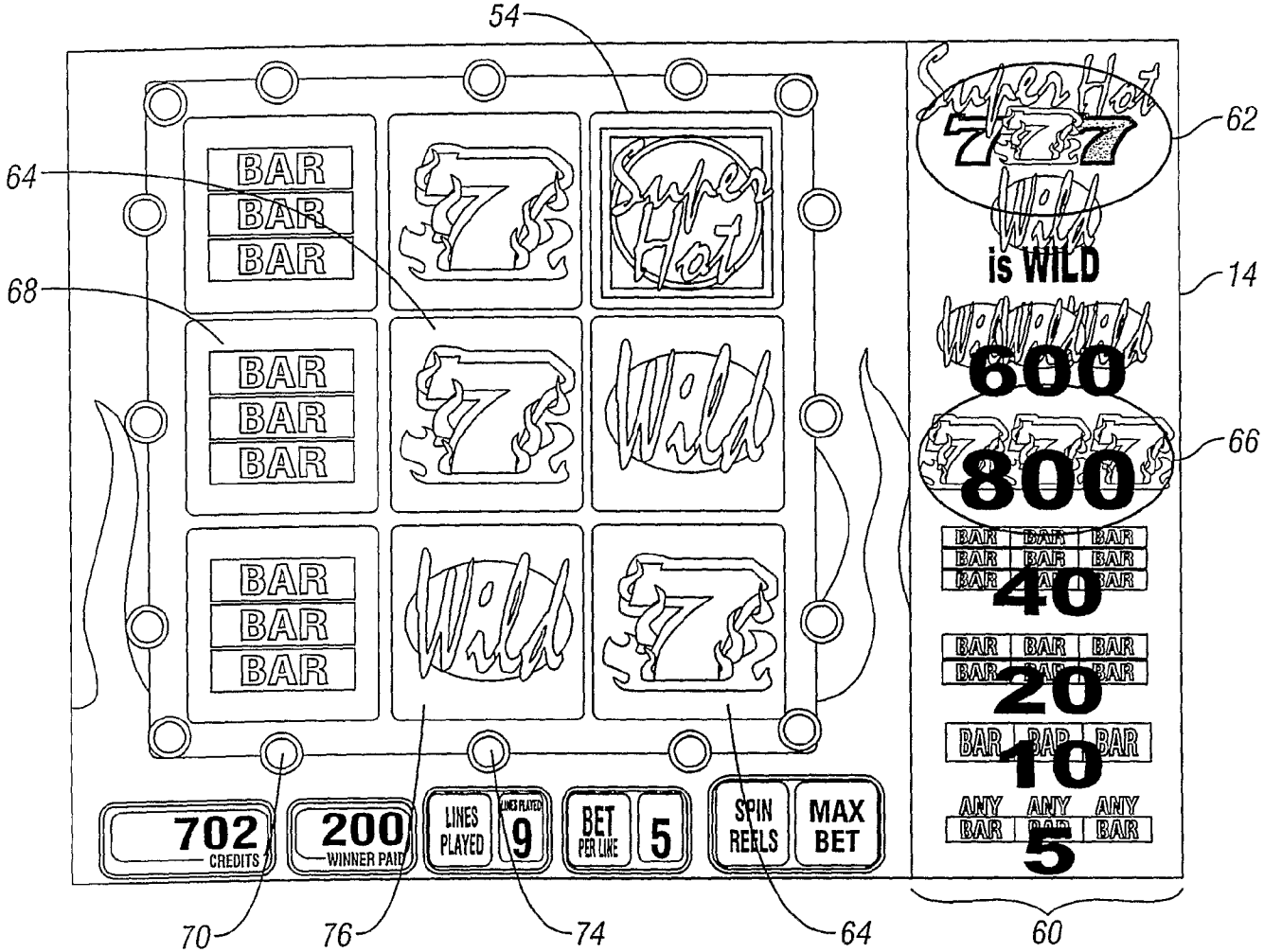
FIGS. 4A and 4B illustrate an exemplary winning outcome for the wagering game shown in FIG. 3 and the resulting change in payoff level for one of the symbols.
Figure 4B:
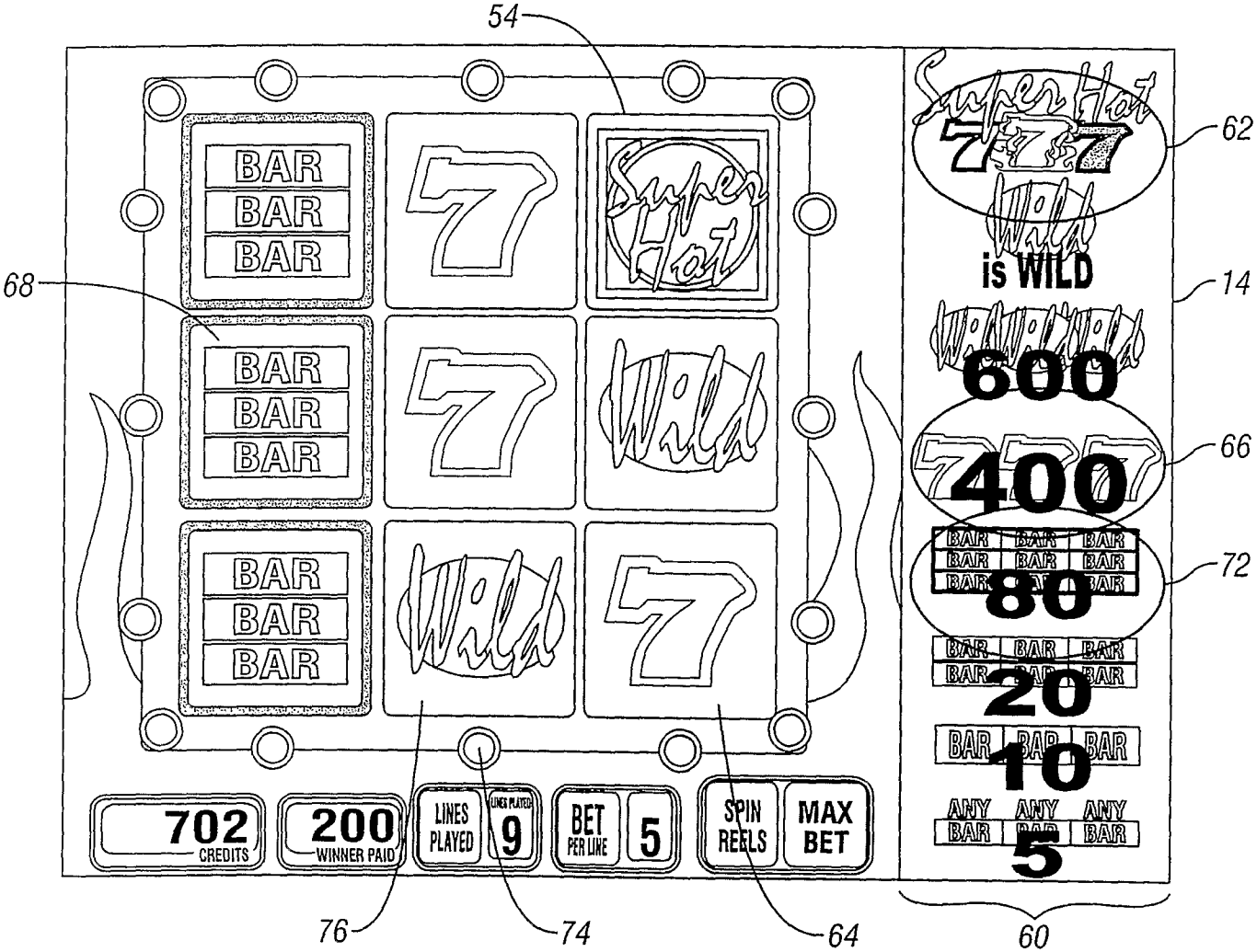

Reassignment of the different payoff levels may occur based on a number of payoff level-changing outcomes on the wagering game. In one embodiment, the payoff levels are reassigned whenever a winning outcome occurs on the wagering game, as shown in FIGS. 4A and 4B. In this embodiment, the payoff level for the reel symbol that resulted in the winning outcome is incremented from the current payoff level to the next higher payoff level. The new payoff level (with its corresponding payoff amount) is then used for subsequent rounds of the wagering game. This can be seen in FIG. 4A, where three "Bar/Bar/Bar" (i.e., "Triple Bar") symbols, one of which is indicated at 68, appearing on an active payline (indicated by the payline indicator 70) has resulted in an award to the player. Based on the white color border surrounding the "Bar/Bar/Bar" symbol 68, the player recognizes that the payoff level currently assigned to this symbol 68 is the "standard" payoff level, with the corresponding payoff amount of 40 credits (see pay table 60). In FIG. 4B, all instances of the "Bar/Bar/Bar" reel symbol 68 are now graphically rendered with a yellow color border to signify that the "standard" payoff level has been incremented to the "intermediate" of "hot" payoff level. The new payoff level, along with the corresponding payoff amount therefor of 80 credits (indicated at 72 in the pay table 60), is then employed for subsequent rounds of the wagering game.

In addition to incrementing the future payoff level of reel symbols that were part of the winning payline, the wagering game may also decrement the future payoff level of one or more other reel symbols that were not part of the winning payline. In one embodiment, the relative changes in payoff levels associated with winning and non-winning symbols and the relative probabilities of achieving winning combinations with those symbols are such that the payback percentage of the wagering game is substantially constant from spin to spin of the reels even though the pay table is dynamic from spin to spin. For example, when incrementing the future payoff level of a winning reel symbol, the wagering game may decrement the future payoff level of another non-winning reel symbol that is currently associated with either an "intermediate" or "high" payoff level. Alternatively, the wagering game may decrement the future payoff level of another non-winning reel symbol that is currently associated with a "standard" payoff level such that the payoff level is effectively "sub-standard" or "cold". In FIG. 4A, for example, the "7" reel symbol 62 is graphically rendered with flames to indicate that its current payoff level is the "high" or "super hot" payoff level. In FIG. 4B, however, the flames have been removed and the "7" reel symbol 62 is rendered simply with a yellow border to indicate its payoff level has been decremented to the "intermediate" of "hot" payoff level, since this symbol was not part of the winning payline. The payoff amount for the "7" reel symbol has been similarly reduced to 400 credits, as indicated at 66 in the pay table 60.

In FIG. 4A, the payline indicated by payline indicator 74 was not selected. As can be seen, however, if that payline had been selected, then the two "7" reel symbols together with the "Wild" reel symbol 76 would have formed another winning payline. But since the "7" reel symbol is already assigned its highest payoff level, the payoff level is not incremented in this alternative scenario. In general, a payoff level may not be incremented above a maximum payoff level or decremented below a minimum payoff level. The "Wild" reel symbol 76 in this scenario, however, may be enhanced in some embodiments, for example, by associating a multiplier with the reel symbol. The multiplier may then be applied to increase the payoff amount in subsequent rounds of the wagering game when the "Wild" reel symbol 76 appears as part of a winning outcome.

The above arrangements allow the wagering game to maintain a dynamic mix of different payoff levels for the various reel symbols, with a winning outcome being one of the triggers for reassigning the payoff levels. Thus, as one reel symbol becomes "hotter" in terms of its payoff level, one or more other reel symbols become "cooler" in terms of their payoff levels, thereby adding to the excitement and enjoyment of the wagering game. Reassignment of the payoff levels may also occur based on other events besides a winning outcome. For example, the incrementing and decrementing of payoff levels may occur at randomly selected times or based on some regular or irregular schedule. Similarly, the reel symbols that have their payoff levels incremented or decremented may be randomly selected (i.e., mystery selection), or they may be selected based on one or more secondary indicia of identification, for example, a watermark appearing on the reel symbol, and the like. Alternatively, the incrementing and decrementing of payoff levels may also occur based on the mere appearance of a particular reel symbol and/or that reel symbol's position in the three-by-three array (i.e., certain positions or patterns may be predesignated for a payoff level change).

At the end of the wagering game session (i.e., when the player departs the gaming machine), the reel symbols 56 may carry their current payoff levels to the next player/wagering game session, or they may have their payoff levels reset to a predetermined initial state. In addition, or alternatively, the departing player may retain the payoff levels of the various reel symbols 56 until his/her next wagering game session. Such retention may be achieved using, for example, a ticket-in-ticket-out (TITO) or account card system well known to those of ordinary skill in the art. Gaming systems that are capable of such retention are generally referred to as "persistent state" gaming systems because they are able to store the current state of the wagering game for a player when that player concludes a gaming session and then restore the current state of the wagering game for that player when the player begins a new gaming session at the same or different gaming machine.

Figure 5:
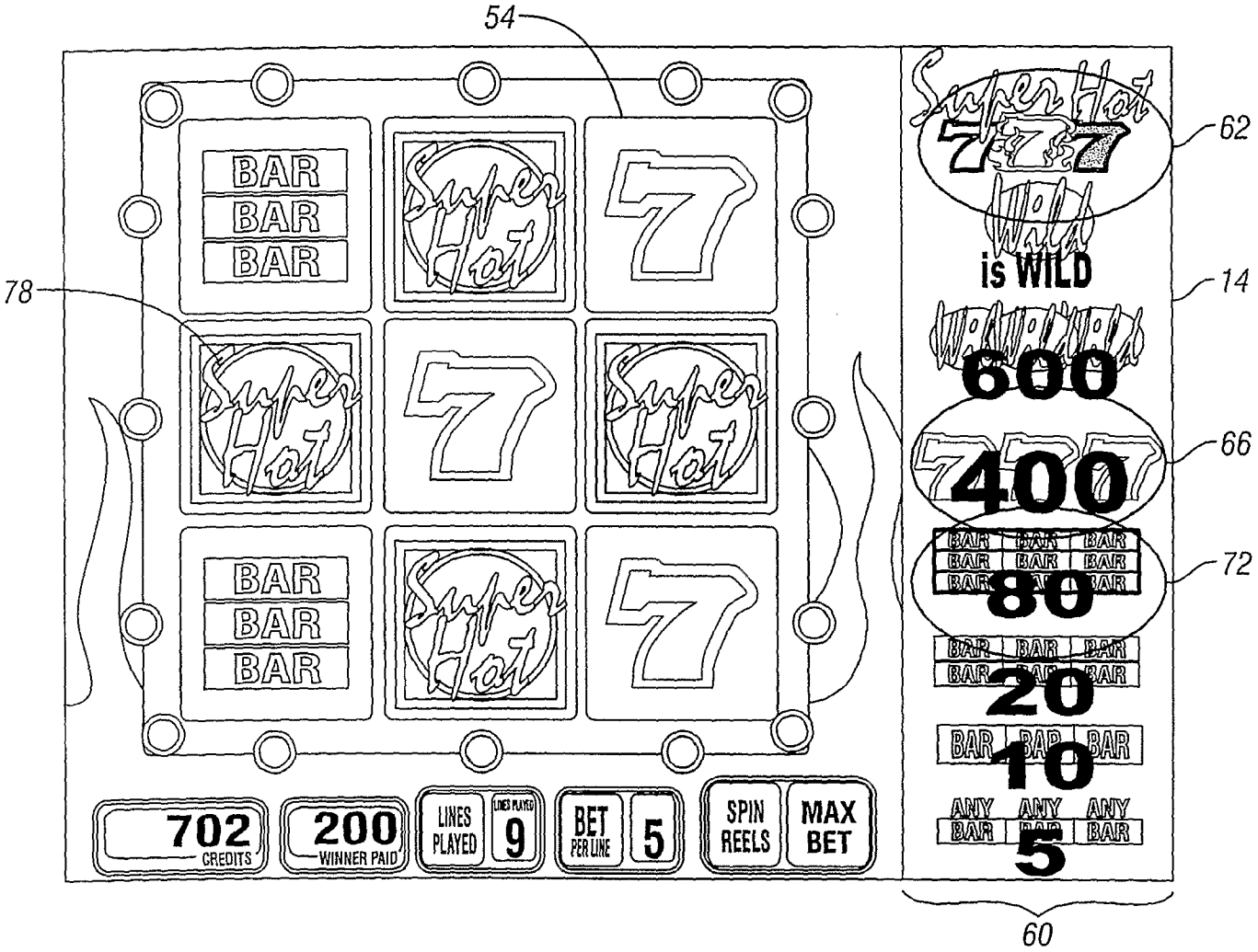
FIG. 5 illustrates an exemplary symbol combination representing a bonus wagering game triggering event in which the symbols are assigned their maximum payoff level.

FIG. 5 illustrates another embodiment of the invention in which the position or configuration of the reel symbol triggers a reassignment of the payoff levels. In this embodiment, a certain reel symbol, such as the "Super Hot" reel symbol 78, has been predesignated as the trigger. When the "Super Hot" reel symbol 78 appears in a predefined configuration, such as a diamond shape, in the three-by-three array, a bonus wagering game is initiated in which the payoff levels for all reel symbols 56 are incremented. The payoff levels may be incremented to the maximum possible level or to some other intermediate level, depending on the particular wagering game. In one implementation, the bonus wagering game is a free-spins game where the player is granted a certain number (e.g., 15) of free spins of the reels 54. In accordance with embodiments of the invention, all reel symbols 56 are reassigned their highest available payoff levels (or to some intermediate level) during the free spins, resulting in a significantly increased bonus award for the player. The reel symbols 56 are then returned to their previous payoff levels upon completion of the free spins.

While the invention has been described with respect to a number of specific embodiments, those skilled in the art will recognize that the innovative concepts described herein can be modified and varied over a wide range of applications. For example, although only three payoff levels (i.e., "standard," "intermediate," and "high") were discuss in the foregoing embodiments, those skilled in the art will understand that it is possible to have more/fewer than three payoff levels without departing from the scope of the invention. It is also possible to have fewer/more reels and/or fewer/more reel symbols than what has been shown here. It is further possible to implement the principles and teachings of the invention in a different type of wagering game (e.g., poker, blackjack, dice, roulette, etc.) besides a slot machine game without departing from the scope of the invention. Each of these embodiments and obvious variations thereof is contemplated as falling within the spirit and scope of the claimed invention, which is set forth in the following claims.

What is claimed is:

1. A gaming system that automatically changes a payoff level of a symbol, the system comprising:

at least one input device;

at least one display device displaying symbols representing an outcome of a wagering game, said symbols including a plurality of instances of a first symbol having a currently assigned one of multiple possible payoff levels;

one or more processors; and a memory device that stores instructions which, when executed by at least one of said one or more processors, cause the said one or more processors to operate with said at least one input device and said at least one display device to:

accept a wager from a player to initiate said wagering game;

display symbols representing said outcome of said wagering game, said outcome being randomly selected from a plurality of outcomes, said plurality of outcomes including a special-event outcome that includes at least two instances of said first symbol; and in response to said randomly selected outcome being said special-event outcome, automatically assign a predetermined next payoff level of said multiple possible payoff levels to said first symbol for a subsequent round of said wagering game.

2. The gaming system of claim 1, wherein said currently assigned payoff level for said first symbol is incremented for said subsequent round of said wagering game.

3. The gaming system of claim 2, further comprising a second symbol having another currently assigned level of multiple possible payoff levels, and wherein said another currently assigned payoff level for said second symbol is decremented for said subsequent round of said wagering game.

4. The gaming system of claim 1, wherein said special-event outcome includes said at least two instances of said first symbol appearing anywhere on said at least one display device.

5. The gaming system of claim 1, wherein said special-event outcome includes said at least two instances of said first symbol appearing in a predetermined location on said at least one display device.

6. The gaming system of claim 1, wherein said special-event outcome is a winning outcome.

7. The gaming system of claim 6, wherein said winning outcome appears along a winning payline, said winning payline including a wild symbol, said wild symbol causing any payoff amount resulting from said wild symbol in said subsequent round of said wagering game to be multiplied by a predetermined multiplier.

8. The gaming system of claim 3, wherein said display device is configured to enhance an appearance of all instances of said first symbol and to deemphasize an appearance of all instances of said second symbol for said subsequent round of said wagering game.

9. The gaming system of claim 1, wherein said multiple possible payoff levels include a predefined maximum payoff level and a predefined minimum payoff level, and wherein said first symbol cannot be incremented above said predefined maximum payoff level or decremented below said predefined minimum payoff level.

10. The gaming system of claim 1, wherein said special-event outcome triggers a special-event game in which all symbols are temporarily incremented to a higher payoff level.

11. A computer-readable, non-transitory medium encoded with instructions that, when executed by one or more processors, cause said one or more processors to operate with at least one input device and at least one display device to:

accept a wager from a player at a gaming machine, said wager initiating a round of a wagering game in which an outcome is randomly selected from a plurality of outcomes including a special-event outcome, said special-event outcome comprising at least two instances of a first symbol having a currently assigned one of a standard payoff level, an intermediate payoff level, and a high payoff level;

displaying said special-event outcome; and in response to said special-event outcome being displayed in said wagering game, automatically assigning a different one of said standard payoff level, said intermediate payoff level, and said high payoff level, to said first symbol for a subsequent round of said wagering game.

12. The computer-readable medium of claim 11, wherein said special-event outcome is a winning outcome.

* * * * *